United States Patent [19]

Maus et al.

[11] 4,117,800

[45] Oct. 3, 1978

[54] DEVICE FOR SPREADING GLUE

[75] Inventors: Dieter Maus, Neuffen; Hermann Buck, Huelben, both of Fed. Rep. of Germany

[73] Assignee: Bielomatik Leuze & Co., Neuffen, Fed. Rep. of Germany

[21] Appl. No.: 839,702

[22] Filed: Oct. 5, 1977

[30] Foreign Application Priority Data

Nov. 16, 1976 [DE] Fed. Rep. of Germany ..... 2652133

[51] Int. Cl.[2] ..... B05C 1/02

[52] U.S. Cl. ..... 118/7; 11/1 AD; 118/261; 156/477 B

[58] Field of Search ..... 11/1 AD; 118/DIG. 9, 118/228, 250, 251, 258, 259, 261, 7; 156/477 B

[56] References Cited

U.S. PATENT DOCUMENTS

| | | | |
|---|---|---|---|
| 767,026 | 8/1904 | White | 118/258 X |
| 2,359,015 | 9/1944 | Winkel | 118/DIG. 9 |
| 3,352,279 | 11/1967 | Lockwood | 118/261 X |
| 3,373,052 | 3/1968 | Rode | 118/261 X |

FOREIGN PATENT DOCUMENTS

| | | | |
|---|---|---|---|
| 2,215,077 | 10/1973 | Fed. Rep. of Germany | 11/1 AD |

*Primary Examiner*—John P. McIntosh

*Attorney, Agent, or Firm*—J. Rodman Steele, Jr.

[57] ABSTRACT

A device for spreading glue on articles such as the abutting ends of stacks of sheet paper or book backs, comprising a rotatable glue-spreading roller which projects from above into a glue supply in a glue tank and is wetted with glue, wipers arranged to act on the surface of the roller in the regions where the roller enters and leaves the glue tank and a level regulating device for maintaining a desired glue level in the glue tank.

16 Claims, 2 Drawing Figures

DEVICE FOR SPREADING GLUE

Figure 1:
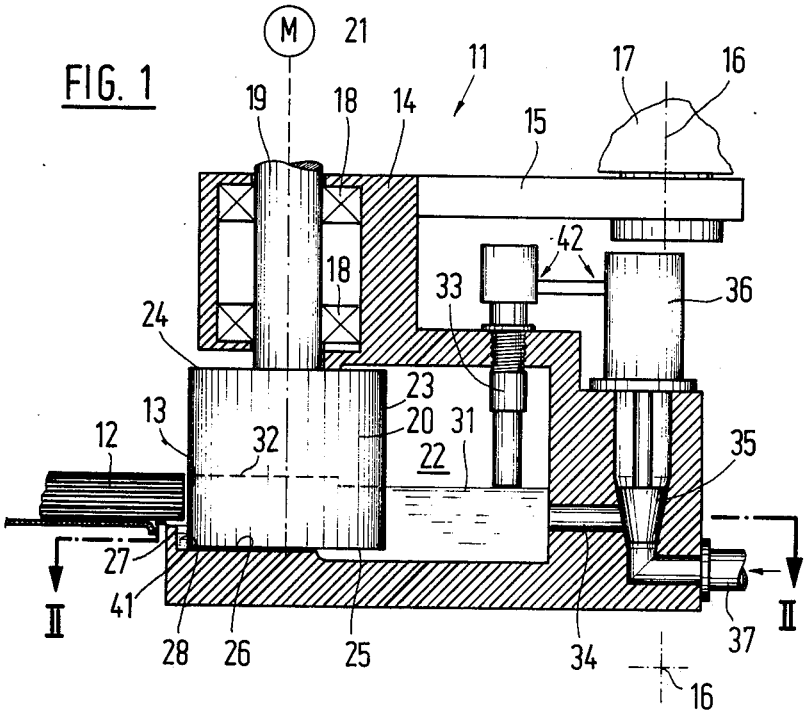

The present invention relates to a device for spreading glue on articles, in particular on the abutting ends of stacks of sheet paper, book backs etc., having a rotatable glue-spreading roller which is wetted with glue in a glue tank and having wipers which act upon the surface of the glue-spreading roller at the inlet and outlet of the glue tank.

Such a device is known from German Auslegeschrift No. 2 215 077 wherein the glue-spreading roller takes the form of a relatively thin disc. The glue tank borders only on the surface of the glue-spreading disc. For this purpose, there is provided, besides the two wipers extending along one surface line, curved wipers which extend on the surface in a peripheral direction. In this device, glue should be prevented from getting on the end faces of the glue-spreading disc. To do this, however, the arched wipers must be used and these are difficult to manufacture and adjust and it is very difficult to adjust the device to differing thicknesses of the articles to be glued. Since it is almost impossible to adjust the wipers in such a manner that not even small quantities of glue escape, the device has to be frequently cleared of hardened glue in this very region of the arched wipers.

The aim of the present invention is to provide a device of the type mentioned initially which, while having improved adjustability as regards the width of the strip to be glued, is simple to manufacture and adjust and to an extensive degree is self-cleaning in use.

According to the present invention there is provided a device for spreading glue on articles such as the abutting ends of stacks of sheet paper or book backs, comprising a rotatable glue-spreading roller which projects into a glue tank and is arranged to, in use, project from above into a glue supply in the glue tank and be wetted with glue, wipers being arranged to act on the surface of the glue-spreading roller in the regions where the glue spreading roller enters and leaves the glue tank, and a level regulating device being provided for maintaining a desired glue tank with a free upper glue surface in the glue tank.

Preferably the glue spreading roller is arranged so that its axis is substantially vertical to the upper glue surface and because of the constantly maintained free upper glue surface the glue-spreading roller is provided with glue only up to a specific depth. By adjusting the level of the glue surface it is therefore possible even during operation to adjust the device easily to differing widths of the strip to be glued. It is therefore possible subsequently to regulate the width of the strip being glued even during operation. The glue-spreading roller is sealed off at the lower end face from the housing of the glue tank in that, for example, it extends tightly adjacent to a housing surface. In most cases, special wipers are unnecessary here.

A glue-collecting channel may be disposed around in the region of the lower edge of the glue-spreading roller outside the tank. Any glue escaping in the region of the end face from the tank and also the glue (and this constitutes the major part) which is not removed by the article in the region of the surface collects in this glue-collecting channel. Since the glue-collecting channel is located in the region of the surface of the glue-spreading roller, it is connected by the inlet wiper to the glue tank. Owing to the rotation of the glue-spreading roller a pump action which constantly empties the glue-collecting channel arises at the inlet wiper. This action may be assisted if the gap at the inlet wiper is greater than at the outlet wiper and in particular if the gap increases in a downward direction, i.e. towards the glue-collecting channel.

Although it is advantageous if the glue-spreading roller is disposed substantially vertically, it is, however, alternatively possible - for example for adaptation to a total device with an inclined conveying plane - to dispose the glue-spreading roller in an inclined manner. What is always fundamental is that the glue-spreading roller still projects from above into the glue surface. With this proviso, the axis of the glue-spreading roller may be inclined both towards the tank and away from it or it may be inclined in such a manner that the articles move past the glue-spreading roller on a downward- or upward-sloping belt.

The level regulating device is preferably a probe which is provided in the glue tank and regulates the supply of glue. As the present invention enables the glue tank to be small, the glue is therefore infrequently rolled round or fed back, and it is thus possible to use quick-setting glues (hot or cold glues). This being the case, there is no need to provide glue feedback. However, it is alternatively possible to construct the level regulating device as an overflow. In this case, however, one must anticipate that the glue is rolled round several times.

Figure 2:
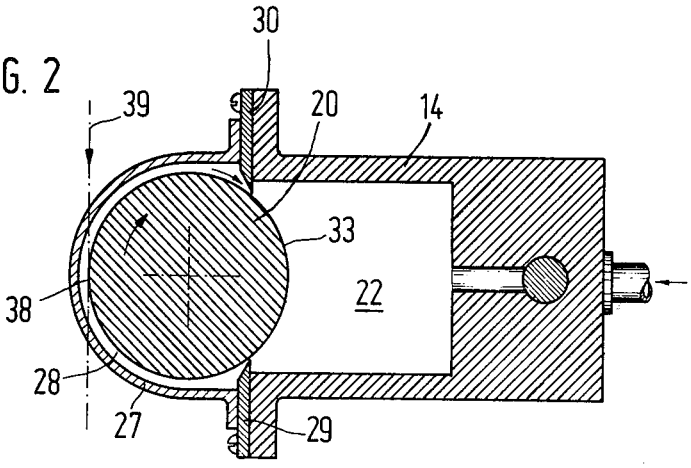

The present invention will now be further described, by way of example, with reference to the accompanying drawings in which:

FIG. 1 is a vertical section through one embodiment of a glueing device according to the present invention; and FIG. 2 is a horizontal section along the line II—II of FIG. 1.

The device 11 illustrated in the drawings is a machine which may be used for manufacturing or for binding books, pads or other articles 12. The articles are generally stacks made up of individual sheets whose abutting ends 13 (book backs) are glued.

The housing 14 of the glueing device 11 is pivotably connected by an arm 15 to the machine frame 17 of the total machine 17 or alternatively to a special carrier for the device. The device is pivotable about the axis 16 whose connection with the glueing point 38 forms an acute angle relative to the conveying device 39 of the articles 12 to be glued. In this way it is possible to raise the entire device from the conveyor line of the surfaces 13 to be glued, by pivoting about the axis 16, thus preventing glue from being applied to the front surface of the article 12 seen in a conveying direction. The raising arrangement is not shown in detail here.

A shaft 19 of a vertically located glue-spreading roller 20 is supported in the housing 14 in bearings 18. The shaft may be driven by a motor 21 in the direction of the arrow 40 (clockwise). Rotation is effected in the opposite direction to the direction 39 in which the articles 12 are conveyed and at a speed which is, for example, 50% higher so that the glue is "smeared" onto the back. However, synchronized glue application is also possible.

The glue-spreading roller 20 has an axial length which is approximately comparable with its diameter. At any rate, compared to the almost disc-like thin spreading elements according to prior art it is relatively elongated. Approximately one third of the glue-spreading roller 20 projects into a glue tank 22 formed in the housing 14. In the illustrated example, not only the corresponding portion of the surface 23 but also the associated part of the upper and lower end faces 24,25 of the glue-spreading roller 20 project into the tank 22.

The lower end face 25 of the glue-spreading roller 20 runs tightly adjacent along a corresponding housing surface 26 so that a seal for the glue tank is produced which need not, however, be complete. Extending on the surface 23 of the glue-spreading roller 20 are wipers 29,30 (skimmers) of which the outlet wiper 29 provides an adjustable film of glue on the surface 23 and the inlet wiper 30 is so adjusted that its inlet gap permits excess glue to run in.

In the region of the lower edge 41 (between the surface 23 and the lower end face 25) of the glue-spreading roller 20 an edge 27 forms a channel 28 whose base is on the same level as the housing surface 26 and whose inner boundary is the surface 23. This channel holds glue which penetrates between the end face 25 and the housing surface 26 but at the same time holds glue which runs down from the surface 23 because it is not removed by the article 12. The channel extends preferably from the output wiper 29 to the inlet wiper 30 but in any case extends near the latter so that the glue collected therein is pumped back as a result of the pump action of the rotating glue-spreading roller through the inlet gap past the wiper 30 into the glue tank 22. For this purpose, the wiper 30 may be so constructed and be so adjustable that in the region of the channel 28 it may be adjusted to a greater gap towards the surface 23 than in the region thereabove.

Disposed in the glue tank 22 is a probe 33 which scans the level of the glue surface 31 in this tank. It is immaterial whether an electrical, electromechanical or otherwise constructed probe is used. However, it is advantageous if this probe operates with a time lag and/or has a specific hysteresis so that regulating fluctuations are avoided or a second probe becomes unnecessary. The probe 33 supplies its signal to a linear drive 36, for example an operating magnet, which actuates a valve body 35 which is disposed between a glue supply channel 34 and a glue supply pipe 37 of the device and therefore opens or blocks the glue supply. The level regulating device 42 comprising the probe 33 and the valve 35,36 therefore ensures a substantially constant level of the glue surface 31 in the glue tank 22. As may be seen in FIG. 1, this glue surface may be set within wide limits so that articles 12 of minimum thickness up to approximately the axial length of the glue-spreading roller 20 may be glued.

On the surface 23 a film of glue is formed whose upper limit 32 is somewhat higher than the glue surface 31 because the film of glue is urged slightly upward by the outlet wiper 29. The upper limit 32 of the glue film is, however, moreover exact and is easily adjustable to the correct level by adjusting the height of the probe 33 (for example by means of an adjusting device (not shown) between the probe and the valve). Surplus glue, which in the known devices dripped down, passes into the channel 28 and is fed back to the glue tank.

It is therefore evident that a glue-spreading device is provided in which the glue-spreading roller may have the axial dimensions of the thickest article to be glued but normally is only partially wetted with glue. There is consequently particularly good adjustment of the width of the glue film and the device operates cleanly without requiring frequent cleaning. The glue tank may be substantially smaller than is shown in the drawings so that the glue has a short dwell time and is only slightly squeezed through, this being particularly damaging with hot glue. When using hot glue, a heating rod may be inserted in the glue tank.

It is particularly advantageously possible to provide the glue tank 22 (having the glue supply, wipers and edge 27) in a housing part which is displaceable relative to the housing part containing the bearings and the glue-spreading roller. This displaceability (pivoting is alternatively possible) would be effected horizontally from left to right or vice versa, for example by means of an adjusting screw. As a result, after a basic adjustment wipers could be adjusted simultaneously and unidirectionally to a greater or lesser glue thickness.

An additional advantage is that the glue tank is easily interchangeable with another, for example, when changing the type of glue or for cleaning.

We claim:

1. A device for spreading glue on articles such as the abutting ends of stacks of sheet paper or book backs, comprising:

a glue tank, a rotatable glue-spreading roller which projects into the glue tank and is arranged, in use, to project from above into a glue supply in the glue tank and be wetted with glue, wipers being arranged to act on the surface of the glue-spreading roller in the regions where the glue-spreading roller enters and leaves the glue tank, and a level regulating device for maintaining a desired glue level with a free upper glue surface in the glue tank, whereby the glue-spreading roller may be wetted with glue over only a part of its axial length, the extent of wetting being determined by the glue level in the glue tank.

2. A device according to claim 1, wherein the glue-spreading roller is disposed so that, in use, its axis is substantially vertical to the upper glue surface.

3. A device according to claim 2, wherein the lower end face of the glue-spreading roller passes in a substantially sealed manner from the glue tank.

4. A device according to claim 3, wherein the lower end face of the glue-spreading roller extends tightly along a housing surface.

5. A device according to claim 1, wherein the lower end face of the glue-spreading roller passes in a substantially sealed manner from the glue tank.

6. A device according to claim 5, wherein the lower end face of the glue-spreading roller extends tightly along a housing surface.

7. A device according to claim 1, wherein the inlet wiper is adjustable to provide a gap between the inlet wiper and the surface of the glue-spreading roller, which is greater in a downwards direction.

8. A device according to claim 1 wherein the level regulating device comprises a probe which is provided in the glue tank and is arranged to regulate the glue supply.

9. A device according to claim 8, wherein the probe operates with a time lag.

10. A device according to claim 1, wherein the level of the glue surface is adjustable.

11. A device according to claim 10, wherein a probe which operates with a time lag forms part of the level regulating device.

12. A device according to claim 1, wherein the glue tank with its wipers is disposed displaceably relative to the glue-spreading roller.

13. A device for spreading glue on articles such as the abutting ends of stacks of sheet paper or book backs, comprising: a glue tank, a rotatable glue-spreading roller which projects into the glue tank and is arranged, in use, to project from above into a glue supply in the glue tank and be wetted with glue, wipers being arranged to act on the surface of the glue-spreading roller in the regions where the glue-spreading roller enters and leaves the glue tank, a level regulating device for maintaining a desired glue level with a free upper glue surface in the glue tank, and a glue-collecting channel in the region of the lower edge of the glue-spreading roller outside the glue tank.

14. A device according to claim 13, wherein the inner limit of the glue-collecting channel is the lower portion of the surface of the glue-spreading roller.

15. A device according to claim 14, wherein the glue-collecting channel ends at the gap between the inlet wiper and the roller.

16. A device according to claim 13, wherein the glue-collecting channel ends at the gap between the inlet wiper and the roller.

* * * * *